United States Patent [19]

Kennedy et al.

[11] 4,337,802

[45] Jul. 6, 1982

[54] METHOD AND APPARATUS FOR LIQUID FILLING OF CONTAINERS

[75] Inventors: Harry L. Kennedy; Prakash M. Kesaree, both of Freeport; Abofazl Rahimzadeh, Lake Jackson, all of Tex.

[73] Assignee: Velasco Scale Company, Inc., Freeport, Tex.

[21] Appl. No.: 192,497

[22] Filed: Sep. 30, 1980 (Under 37 CFR 1.47)

[51] Int. Cl.[3] ..... B65B 3/28

[52] U.S. Cl. ..... 141/1; 141/83; 141/87; 141/90; 141/93; 141/128; 141/264

[58] Field of Search ..... 141/250–284, 141/83, 1–12, 94, 95, 96, 37–66, 128, 375, 87, 90, 93

[56] References Cited

U.S. PATENT DOCUMENTS

| | | | |
|---|---|---|---|
| 3,559,702 | 2/1971 | Riesenberg | 141/263 |
| 3,797,890 | 3/1974 | Walters | 141/128 |
| 4,211,263 | 7/1980 | Kennedy et al. | 141/83 |

OTHER PUBLICATIONS

Brochure of Toledo Scale, "Toledo 9117 Semi-Automatic, Sub-Surface Drum Filler" (4 pages).

Brochure of National Controls, Inc., "Mantes Semi-Automatic Drum Filler", 1972 (1 page) (Model 16-MSSF).

Brochure of National Controls, Inc., "Mantes Semi-Automatic Keg & Pail Filler", 1972 (1 page) (Model 22-MCSSF).

*Primary Examiner*—Frederick R. Schmidt

*Attorney, Agent, or Firm*—Arnold, White & Durkee

[57] ABSTRACT

An improved liquid filling apparatus for subsurface filling of a container is characterized by an arrangement permitting automatic withdrawal of the filling lance while maintaining a subsurface relationship of the discharge end of the filling lance with the liquid dispensed into the container. The apparatus includes a wheeled carriage which moves along a stanchion, the carriage being operatively associated with the filling lance. A wiper ring assembly, a drip collection assembly, and a fume disposal assembly which contains or entraps substantially all sources of fume generation are also provided as part of the filler apparatus.

18 Claims, 8 Drawing Figures

Fig. 3
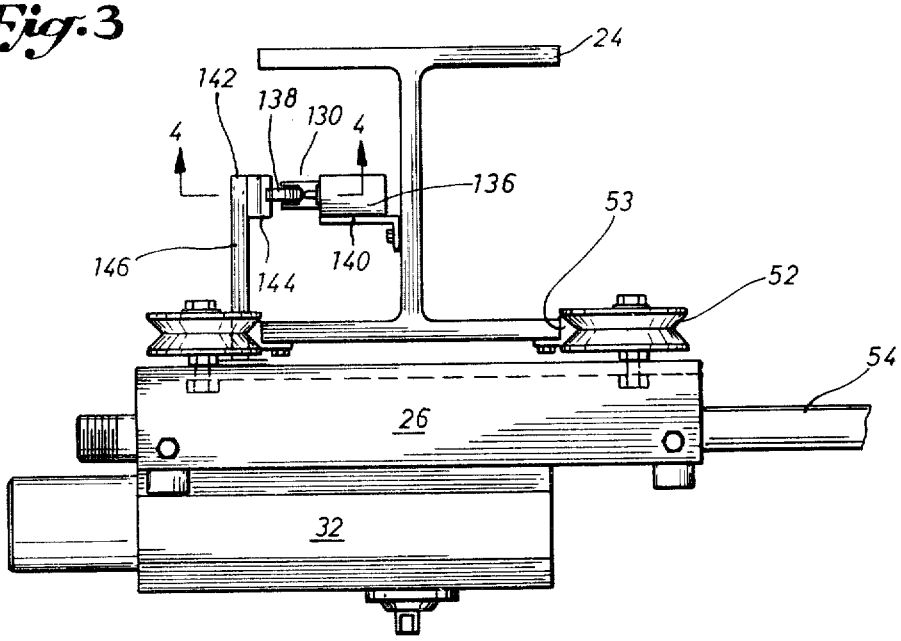
Fig. 4
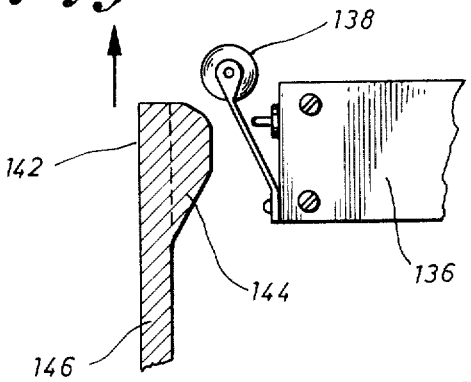
Fig. 5
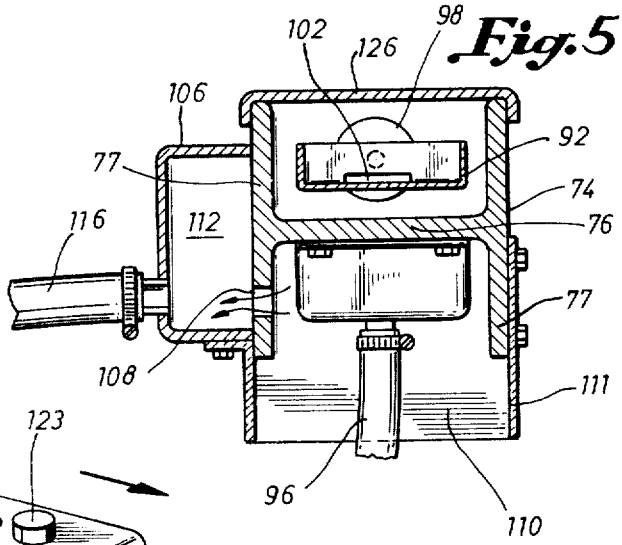
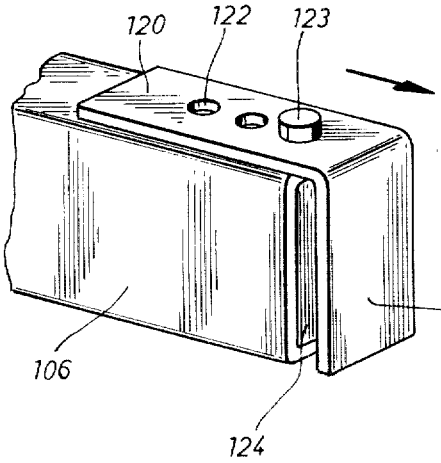
Fig. 6

50
46
HCD
HCU
RAM CYLINDER
176
LUBRICATED AIR SUPPLY
158
156
US
152A
DAS
154
UPPER LIMIT SWITCH
130
DRIP PAN CYLINDER
98
132
MIDDLE LIMIT SWITCH
172
FOOT VALVE CYLINDER
FVC
170
REGULATOR
168
166
PREFILL
162
164
165
LOWER LIMIT SWITCH
134
160
TO FOOT VALVE CLOSE (FVC)
DRY AIR SUPPLY
(DAS)
174
DS
150
36
178
DRY AIR SUPPLY
152
(DAS)
REGULATOR
FINAL CUT-OFF
FIRT CUT-OFF

METHOD AND APPARATUS FOR LIQUID FILLING OF CONTAINERS

BACKGROUND OF THE INVENTION

This invention relates to an apparatus and method for dispensing predetermined amounts of liquid by weight into a container and, in particular, is directed toward an improved apparatus and method for dispensing liquid into a container of the type shown in U.S. Pat. No. 4,211,263, which patent is hereby incorporated by reference. U.S. Pat. No. 4,211,263, which patent issued to the assignee of the present application, provides background information for the present invention.

In most facilities adapted for the filling of liquids into containers, the containers to be filled are conveyed by a suitable roller conveyor or like apparatus past a number of stations at which particular functions related to the filling of the container occur. For example, the empty containers are usually introduced singly onto the conveyor and may be carried past a first station whereat the liquid-receiving opening of each container is aligned or oriented into a predetermined position. The containers might also be oriented at the filling station. At the filling station, a predetermined quantity of liquid is introduced into the container.

Depending upon the nature of the liquid, any of several filling techniques may be utilized to dispense the predetermined metered amount of liquid into the container. If the liquid is susceptible to foaming, it is typically the practice to insert a filling lance (the conduit through which the liquid passes into the container) into the container such that the lower, discharge end of the lance is in close proximity to the bottom of the container. The movement of the filling lance is normally initiated by the operator of the filling apparatus. A predetermined small amount of liquid is then slowly introduced into the container until the level of liquid in the container rises above the discharge end of the lance. Since the discharge of the lance is thereafter below the level of liquid in the container, most of the remaining weight of the liquid may be introduced into the container at a relatively faster fill rate until the fill rate is slowed down (to a dribble fill rate) just before the final weight of liquid has been dispensed. During the fast fill operation, the lance is normally withdrawn from the container but at a rate which maintains the end of the lance below the liquid surface in the container. The withdrawal of the lance is generally controlled by the operator in order to maintain the discharge end of the lance subsurface.

Once the predetermined amount of liquid has been introduced into the container, the lance is fully withdrawn. As noted, for subsurface fill operations, a problem has existed in that the operations of liquid filling apparatus have had to control the withdrawal of the lance during the fill, keeping the lance subsurface to avoid foaming and the like and yet sufficiently withdrawn that the accuracy of the weight of liquid introduced was not significantly influenced by the weight of liquid within the lance. Further concern existed for the operators when working with toxic or noxious liquids, as it was desired to keep a minimum of the outside surface area of the lance from contamination by submergence in the liquid. As disclosed in the incorporated reference, U.S. Pat. No. 4,211,263, a wiper ring may be utilized about the lance to help alleviate this latter problem. In addition to the strain placed on operators to carefully monitor and control the lance withdrawal, it is believed that some inaccuracy in the final fill weight tends to occur because operators will withdraw the lance slower than necessary to avoid breaking the surface of the liquid.

Upon completion of the fill, the container will normally be conveyed along the line to another station where the container is capped.

It is believed advantageous to provide a liquid filling device that automatically controls the movement of the filling lance at the various stages in the filling process and, in particular, the withdrawal of the lance during a subsurface fill operation. It is also believed to be advantageous to provide a means for controlling fumes and excess material in a safe and efficient manner. It is further believed to be advantageous to provide a liquid filling apparatus which is of relatively simple construction and comprised of components easily maintained and operated, such an arrangement enhancing the safety and control of filling apparatus used with hazardous liquids.

The present invention may be used to make an improved liquid filling lance for U.S. Pat. No. 4,211,263, the incorporated reference.

SUMMARY OF THE INVENTION

The above-noted and other drawbacks of the prior art are overcome, and the advantages stated above are achieved by providing an apparatus for filling containers which automatically controls the movement of the filling lance, and, in particular, for subsurface filling operations, automatically initiates the withdrawal of the lance during the closing stages of the filling operation and controls that withdrawal such that the emission end of the lance is not raised above the surface of the liquid in the container until the desired weight of liquid has been dispensed into the container. Further, this invention features a simple construction including a wheeled carriage which operates to reciprocate the filling lance as well as to actuate signals for initiating various operations dependent upon or relating to the particular position of the carriage and filling lance. The apparatus of this invention also provides for a drip collection apparatus and a fume disposal apparatus which permits more extensive control and regulation of the removal of the fumes from the area of the filling operation.

According to one aspect of the invention, the liquid filling apparatus is of a particularly simple and durable construction for increased dependability and efficiency in liquid filling operations and includes a movable conduit having an emission end for the passing of a liquid into a container and a first signal generator or start mechanism for actuating the movement of the conduit from a raised position out of the container to a lowered position in which the emission end of the conduit is disposed just above the bottom of the container. A control valve which is operable to pass liquid at a dribble or fast-fill rate is interposed between a liquid source and the conduit. A second signal generator is included, which generates a signal to actuate the dribble filling of the liquid when the emission end of the conduit reaches a position just above the bottom of the container and to actuate a delay mechanism, which, in turn, triggers the fast-fill of liquid into the container after a predetermined interval when the emission end of the conduit has been submerged in liquid. Also included is a weight responsive device, such as a scale, which is adapted to generate first and second control signals when the weight of liquid within the container reaches a first and second cut-off weight, respectively. The first control signal initiates the upward movement of the conduit, terminates the fast-filling of the liquid into the container and triggers a dribble fill rate of liquid. Finally, a third signal generator operates to produce a signal to stop the conduit at a predetermined position substantially withdrawn from the container but with the emission end of the conduit still submerged in the liquid in the container. The second control signal actuates the termination of the dribble filling of the liquid and actuates movement of the conduit back to its raised position.

According to another aspect of the invention, a movable drip collection reservoir is disposed beneath the emission end of the conduit when the conduit is in its raised position. The movable drip collection reservoir is caused to withdraw from the path of the conduit in response to the signal from the first signal generator or start mechanism. A fourth signal generator is provided which is actuated by the return of the conduit to its first position and responds with a signal which actuates the return of the drip collection reservoir to a position beneath the conduit.

In a preferred embodiment, the liquid filling apparatus of this invention includes a base having a stanchion extending upwardly and a carriage mounted for movement along the stanchion. A filler lance having an emission end is mounted for movement with the carriage. The control valve, with its actuator, is mounted to the carriage and communicates between a liquid source and the filling lance. The carriage includes a trip mechanism for actuating the second signal generator, the third signal generator, and the fourth signal generator as it moves from its raised position to its lowered position to its intermediate position and back to its raised position along the stanchion. An arm assembly extends outwardly from the stanchion over a container to be filled and is positioned such that the filler lance extends through the outer end of the arm in a guided relationship therewith as the lance is moved with the carriage into and out of a container. The arm assembly includes a wiper ring apparatus for wiping liquid which is collected on the outside surface of the lance as it is withdrawn from a container; a fume disposal apparatus which entraps fumes generated by the liquid being introduced into a container and permits them to be drawn away from the area of the filling operation; and a drip collection apparatus which catches drips from the lance after the lance is withdrawn from a container.

According to one feature of the invention, the drip collection reservoir is movable between a position underneath the lance to a position removed from the path of the lance with the collection reservoir having a drainage port which is always disposed above a fixed collection receptacle no matter what position the movable drip collection reservoir is in. The fixed collection receptacle has a drainage port which communicates with a stationary hose for removing the collected liquid to an area away from the filling operation.

Another feature of the invention is in the use of a baffle plate with the fume disposal apparatus or assembly to allow adjustment of the removal forces acting upon the fumes in the area of the filling operation. Yet another feature of the fume disposal apparatus is its arrangement to contain and provide for the disposal of fumes generated from liquid contamination on the wiper ring apparatus, the outside surface of the filling lance and in the drip collection apparatus, in addition to controlling the fumes generated from the liquid within the container.

According to another aspect of the invention, the filler lance is provided with a foot valve at its emission end, which foot valve is movable between an open and closed position. The foot valve opens in response to a signal from the second signal generator and closes in response to the second control signal. This increases the accuracy of the weight of liquid which is introduced into the container by preventing dispensation of liquid within the filler lance at the time the control valve is closed.

Accordingly, it is a general object of the present invention to provide a new and improved liquid filling apparatus of particularly simple and durable construction which is effective for accurate dispensation of predetermined weights of liquid and which enhances the safe and efficient handling of toxic or noxious liquids in a filling operation.

The above and other features and advantages of the present invention will become more apparent from a detailed description of a preferred embodiment when read in conjunction with the drawings.

BRIEF DESCRIPTION OF THE DRAWINGS

FIG. 3 is a top view of the stanchion portion of the liquid filling apparatus shown in FIG. 1;

FIG. 4 is an exploded sectional view of the relationship of the trip mechanism and limit switch assembly taken along section lines 4—4 in FIG. 3;

FIG. 5 is a sectional view of the arm assembly of the present invention taken along section lines 5—5 in FIG. 2;

FIG. 6 is an exploded perspective view of the baffle arrangement of the fume disposal channel mechanism for use with the liquid filling apparatus of FIG. 1;

DETAILED DESCRIPTION OF THE INVENTION

Figure 1:
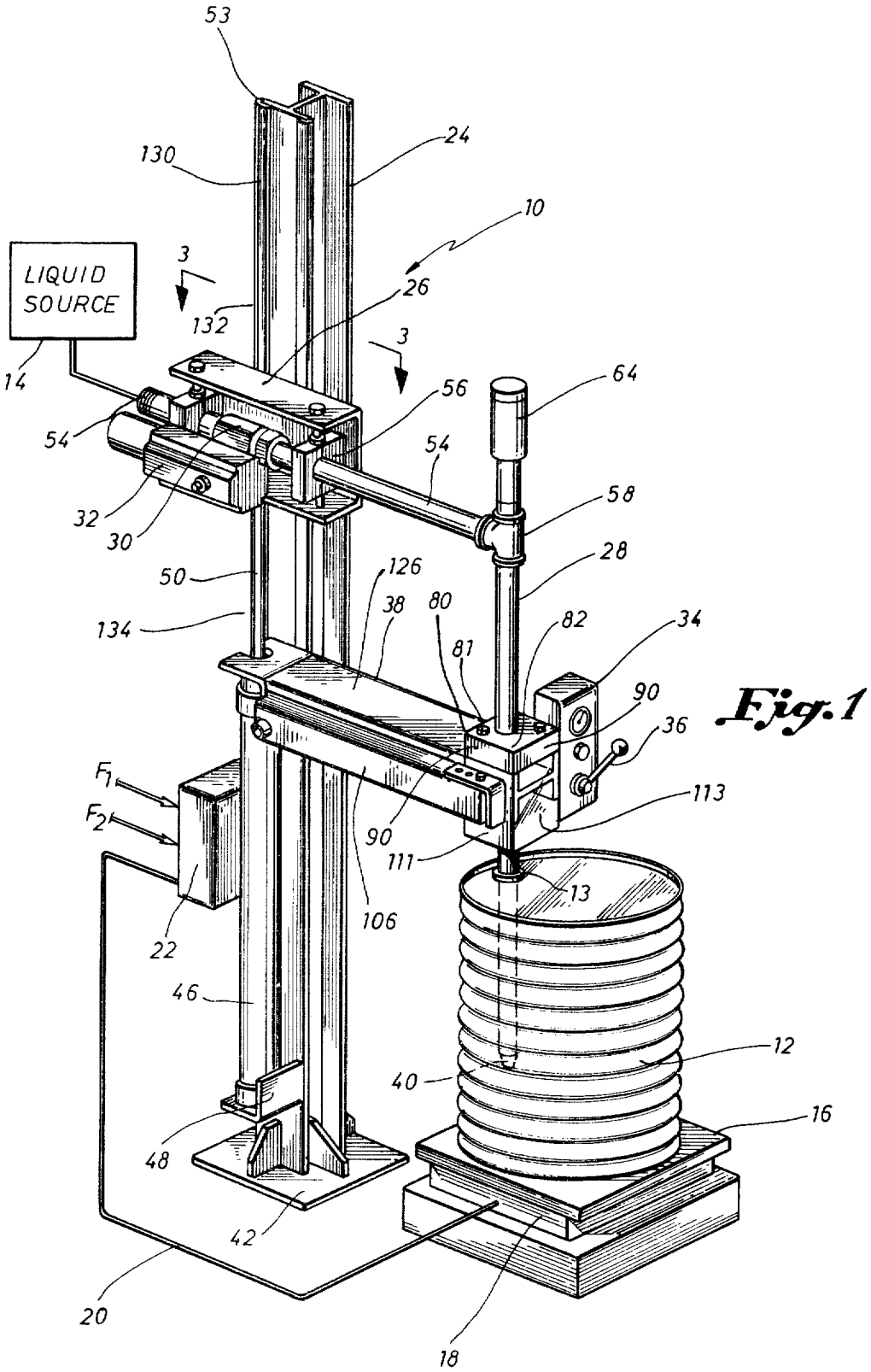
FIG. 1 is a perspective view of a liquid filling apparatus in accordance with this invention as disposed before a container base or conveying line.

Throughout the following detailed description, similar reference numerals refer to similar elements in all Figures of the drawings.

Referring first to FIG. 1, there is shown a liquid filling apparatus generally indicated by reference numeral 10 in accordance with the present invention. A container 12, which is to be filled with a liquid product from a source or reservoir 14, may be conveyed by manual or mechanical means from a receiving or storage area to the filling apparatus 10. Such a container receives a predetermined weight of liquid product from the filling apparatus. The container may then be moved to a discharge area.

More specifically, a container 12 is moved into position before the filling apparatus on a base area 16 adjacent to the filling apparatus. The base 16 may, for example, be a portion of a conveyor system. Disposed beneath the base is a scale 18 for determining when the container has been appropriately filled. This scale may consist of mechanical or electronic elements which are capable of generating control signals along line 20 to a control panel 22 for the filling apparatus 10, such control signals being generated as described in the incorporated reference when the predetermined first and second cut-off weights are reached.

The filling apparatus is comprised of a stanchion 24 upon which a carriage 26 may move to cause the translation of a liquid conduit or filler lance 28 from a position above the container 12 to a position within the container. A control valve 30 and an actuator 32 as described in U.S. Pat. No. 4,211,263 are affixed to the carriage 26 and are disposed between and in communication with the source of liquid 14, which may be situated behind the filling apparatus 10, and the filler lance 28. The flow of liquid into the container 12 may be introduced at a fast or dribble fill rate pursuant to appropriate actuation of the control valve 30.

Operations of the filling apparatus 10 as herein described are pneumatically instigated, the pneumatic circuitry being housed in a control panel 22. It will be appreciated, however, that alternative means for actuating he apparatus of this invention, such as electrical signals, could be used.

A starter box 34 is mounted to the assembly arm 38 and includes a start lever 36 which is movable between "on" and "off" positions. Movement of the start lever 36 downward generates a start signal, described hereinafter, which initiates the operation of the filling apparatus 10. The pneumatic connections and fittings between the starter box 34 and the control panel 22 are not shown.

When liquids which tend to foam or which generate fumes or noxious odors are being introduced into a container, a subsurface fill technique is utilized. The conduit or lance 28 must be introduced into the container until its emission end 40 is disposed just above the bottom of the container. In accordance with the invention, the lance 28 is mounted for vertical reciprocation by the translation of the carriage 26 along the stanchion 24.

As will be appreciated hereinafter, the liquid filler apparatus of this invention may be constructed of standardized components and exhibits a design which is believed manufactuable with a low material and labor cost.

The stanchion 24, in the form of an upright structural H-beam, may be suitably affixed, as by welding or support legs, to a base plate 42 which in turn may be secured to the work surface or floor, as by bolts 44. A hydraulic or pneumatic ram 46 is supported on a bracket 48 rigidly affixed to the outside of one flange of the H-beam forming the stanchion 24.

A piston rod 50 of the ram is connected by its upper end to the carriage 26. An outstanding feature of this invention is the use of a wheeled carriage on the stanction 24 to reciprocate the filling lance. The carriage 26 may be formed substantially from a channel iron and includes an array of four wheels, or rollers 52. The rollers 52 are paired to grip tracks 53 on the rails or edges of the flange of the H-beam stanchion 24, as best illustrated in FIG. 3.

The forward portion of the carriage 26 (opposite the side carrying the rollers) is provided with a control valve 30 and actuator 32 such as described in detail in U.S. Pat. No. 4,211,263, the incorporated reference. These elements are secured as part of liquid inlet pipe 54 to the carriage 26 by a pair of brackets 56. The inlet pipe 54 receives liquid from a supply source 14 which may conveniently be located behind the filling apparatus. The inlet pipe 54 also communicates with the lance 28 through a T-fitting 58.

Figure 7:
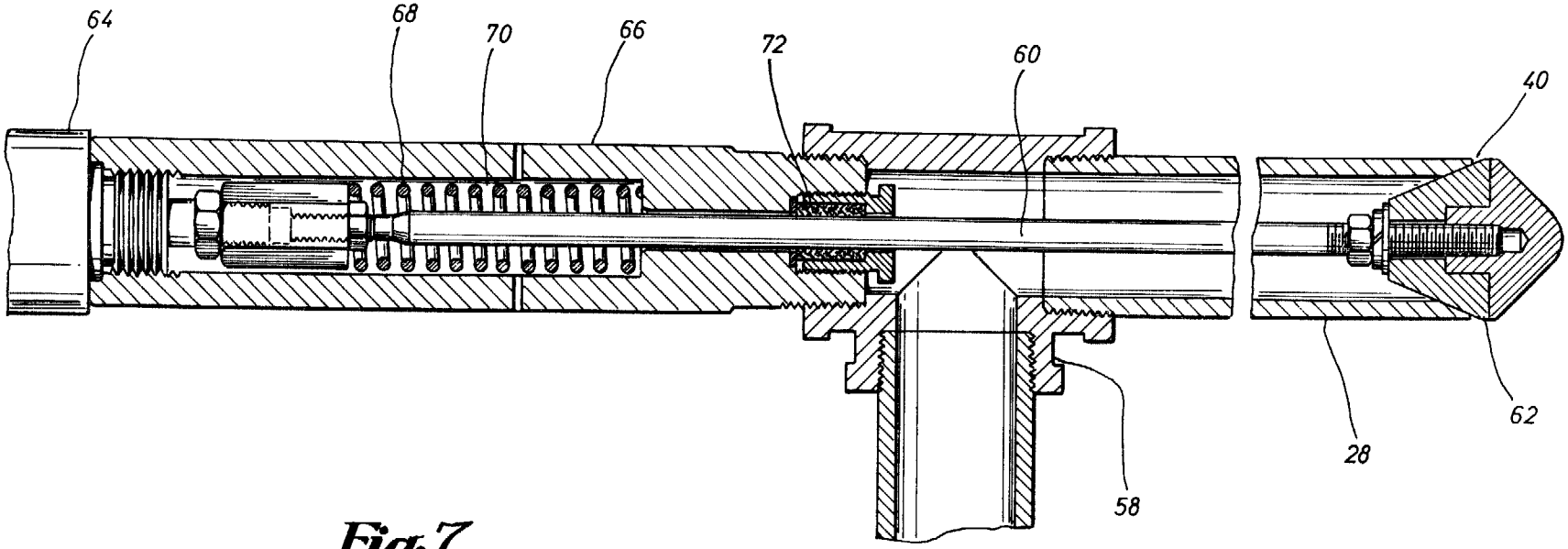
FIG. 7 is a sectional view of the lance assembly in accordance with the instant invention.

The lance 28 is provided with a valve rod 60 which extends centrally and axially therethrough and terminates in a foot valve 62, as shown in detail in FIG. 7. Foot valve 62 is reciprocally movable between a closed and an opened position by the action of a pneumatic foot valve actuator 64. An adapter 66 mounted between the foot valve actuator 64 and the T-fitting 58 includes a spring 68 which is compressed when the pneumatic foot valve actuator 64 is charged and which assists in urging the valve rod 60 and foot valve 62 to a closed position when the pneumatic signal to the foot valve actuator 64 is terminated. While the foot valve 62 is normally closed by a pneumatic signal, the spring 68 will close the foot valve 62 as a safety precaution if a failure occurs in the pneumatic control. The spring chamber 70 of adapter 66 is sealed about the valve rod 60 from the liquid entering the lance by a "V" packing 72, preferably made of Teflon.

The provision of the foot valve 62 permits further control over the accuracy of the weight of liquid introduced into the container 12. As will be more fully explained, the foot valve 62 will be actuated to close with the control valve 30 when the second or final cut-off weight has been achieved, thereby elminating the introduction of the liquid weight existing in the inlet pipe and lance after final cut-off weight has been achieved.

The filling apparatus 10 includes an arm assembly 38 which incorporates a lance wiper ring apparatus, a drip collection apparatus and a fume disposal apparatus. As indicated previously, it is often necessary to deal with liquid substances which may be highly toxic or noxious, and special care must be taken to avoid any contamination or leakage occurring during or as a result of the filling operation.

The arm assembly 38 includes an H-beam section 74 (see FIG. 5) which is rigidly fixed to the stanchion 24 and extends outwardly therefrom. The horizontal web 76 of H-beam includes a first opening 78 at its outer portion which permits the lance 28 to pass through the arm assembly 38 during a filling operation, which is best illustrated in FIG. 2.

Figure 2:
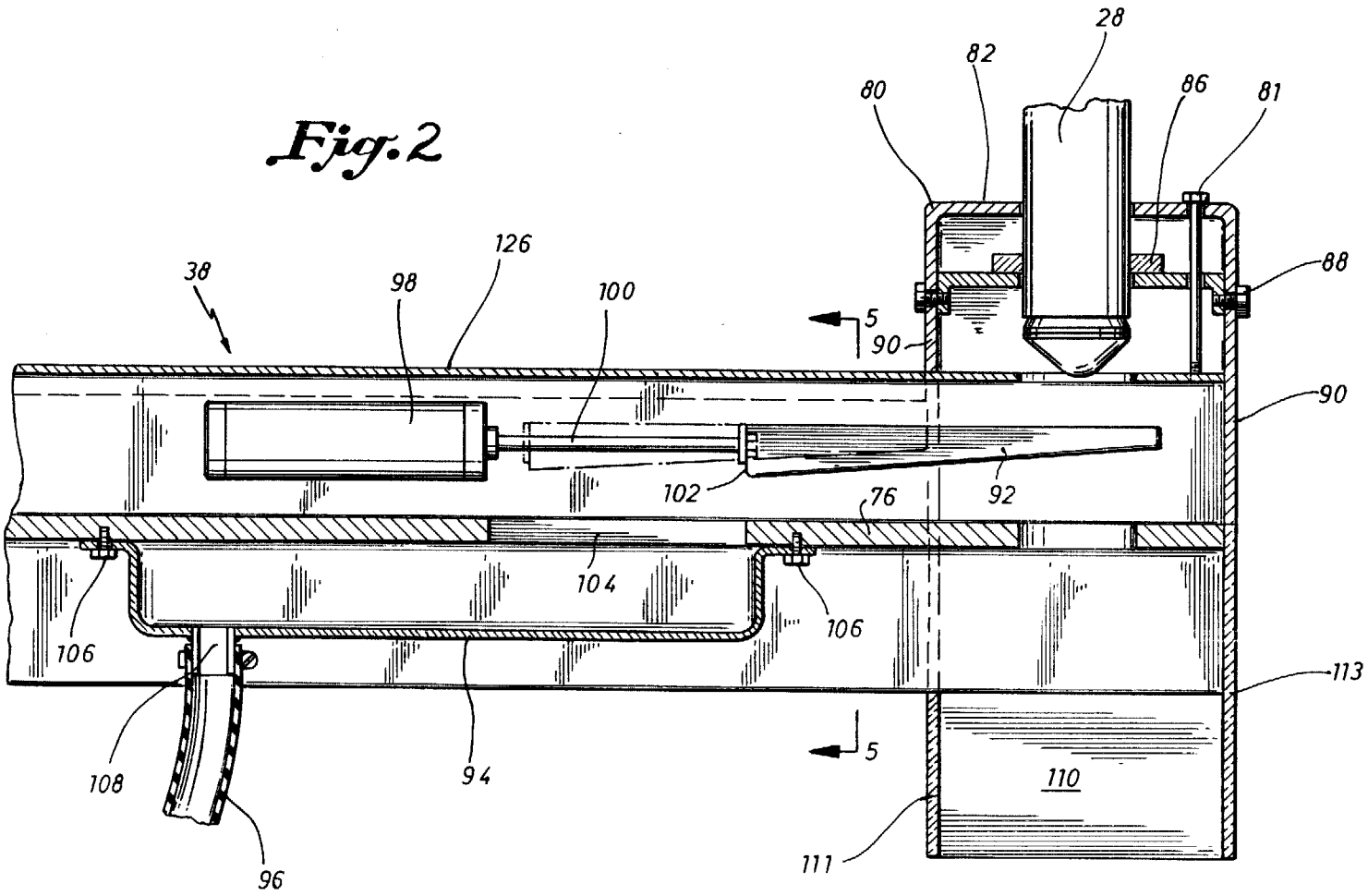
FIG. 2 is a side section view of the arm assembly of the present invention wherein the lance is in a fully withdrawn position.

The wiper ring assembly, as shown in FIGS. 1 and 2, includes a box arrangement 80 which is appropriately affixed to the end of the H-beam 74 of the arm assembly as by bolts 81. The top plate 82 of the box arrangement has a central aperture 84 which is axially aligned with opening 78 in the horizontal web 76 of the H-beam 74. A wiper ring 86 is disposed immediately below and is axially aligned with the central aperture 84 of the top plate 82. The wiper ring 86 is loosely held in place against the top plate 82 by bolts 88 extending through the side plates 90 of the box arrangement 80. The lance 28 extends through the central aperture 84 in the top plate and through the wiper ring 86 when in its raised position and does not withdraw therefrom during any portion of the filling operation. As will be discussed herein, the wiper ring 86 serves to remove any liquid particles which may remain on the surface of the lance 28 as the lance is withdrawn from a container.

An outstanding feature of the invention includes the drip collection assembly which consists of a movable drip pan 92, a fixed drip outlet tray 94, and a stationary drainage hose 96. The drip pan 92 is movable between first and second positions by a piston-cylinder assembly 98 which is controlled by the pneumatic circuitry depicted in FIG. 8. A spring element within piston-cylinder assembly 98 (not shown) urges the drip pan 92 toward its second position whenever a pneumatic air signal to the piston-cylinder assembly 98 is interrupted. The drip pan 92 and piston-cylinder assembly 98 are arranged in the region defined by the horizontal web of H-beam 74 and the upper positions of its vertical flanges 77.

In its first position, the drip pan 92 is extended forward by a piston rod 100 of the piston-cylinder assembly 98 such that it is disposed beneath the lance 28. The base of the drip pan 92 is declined rearwardly such that any liquid collected therein will be urged toward an opening 102 in the rear wall of the drip pan. Liquid passing through the opening 102 will fall through a second opening 104 in the horizontal web of H-beam 74 to the fixed drip outlet tray 94. The drip outlet tray 94 is secured to the underside of the horizontal web of the H-beam in an appropriate manner such as by the bolts 106. The drip outlet tray 94 includes a drain opening 108 which communicates with the stationary drainage hose 96. The drainage hose 96 is appropriately secured and sealed to the outlet tray (fittings not shown) and may be connected to an appropriate storage reservoir. The stationary drainage hose 96 represents an important feature in that it avoids problems which occur with hoses which must translate with the drip pan, such problems including wear and fatigue on the hosing and its seals. These problems may be critical when the filling apparatus is being utilized to handle highly toxic or noxious liquids.

As will be explained, the start lever 36 generates a pneumatic signal which causes the piston-cylinder assembly 98 to withdraw the drip pan 92 to its second position which leaves the lance 28 free to pass through the opening 78 in the H-beam 74. When the drip pan 92 is in its second position, the opening 102 still remains disposed above the second opening 104 in the web 76 of the H-beam and the drip outlet tray 94, such that any liquid remaining in the drip pan will be appropriately drained and collected.

The fume disposal apparatus is another outstanding feature of the invention. As best depicted in FIGS. 1 and 5, the fume disposal apparatus includes a channel element 106, such as a channel iron, closed at its ends and mounted, as by welding or bolts (not shown), to an outside flange of the H-beam 74 of the arm assembly 38. An opening 108 in the side flange 77 is provided such that the fume entrapping region 110 formed by the underside of the horizontal web 76, the lower portions of the H-beam flanges 77, and a fume skirt 111 is in communication with a closed chamber 112 of the channel element 106. An exit port 114 exists in the rear portion of the fume disposal assembly to accommodate a hook-up with a hose 116 and a vacuum arrangement (not shown) which can be utilized to draw the fumes from the area of the container opening 13, for appropriate handling and dispensation.

The fume skirt 111 consists of a box having three sides of metal and a forward wall 113 of glass which is appropriately mounted, as by bolts, to the underside of the outer end of the arm assembly 38. The glass wall 113 permits the operator to view and align the bung opening 13 of a container 12 prior to beginning a filling operation.

In the preferred embodiment, a baffle arrangement is provided to permit more extensive control over the drawing of fumes away from the filling area. As shown in FIG. 6, the baffle arrangement consists of an L-shaped closure 118 mounted at the outer end of the fume channel iron 106. The upper flange 120 of the L-shaped closure includes a series of bolt apertures 122 which permit the closure 118 to be affixed to the fume channel iron 106 by a bolt 123 in several positions. Other arrangements permitting adjustability of the closure 118, such as a continuous notch or slot rather than individual apertures 122, may be used. This arrangement allows full closure of the end of the fume channel iron 106 as well as an incremental variance of the air admittance area 124 at the end of the fume channel iron.

The baffle arrangement becomes very important when the vacuum source being utilized cannot be adjusted as to its drawing force, and the liquid being inroduced into the container is of a density which would likely allow an inappropriate amount of liquid molecules to be drawn out with the exhaust fumes. The baffle arrangement permits the operator to vary the drawing force acting on the liquid fumes by increasing the area from which air can be drawn.

The upper region defined by the H-beam 74 is enclosed by a fume hood cover 126 best depicted in FIGS. 1 and 5. The fume hood cover 126 may be formed of any suitable galvanized sheet metal material and provides the means whereby the upper region of the arm assembly 38 may be closed.

Another outstanding feature of this invention is the arrangement of the fume disposal apparatus to essentially contain all sources of fumes. Not only is the area immediately about the container opening controlled, but the wiper ring and the unwiped portion of the fully withdrawn lance, which are contaminated with the liquid, as well as the movable drip pan and the fixed collection receptacle, are situated within the arm assembly 38 so that all fumes may be controlled and evacuated by the fume disposal apparatus.

Referring now to FIG. 3, an upper limit switch assembly 130 is shown as it appears on the back side of the stanchion 24. Although only the upper limit switch 103 is shown, the stanchion has two other limit switch assemblies, a middle limit switch 132 and a lower limit switch 134 mounted in similar fashion and whose general positions on the backside of the stanchion 24 are indicated in FIG. 1. The limit switches 130, 132, and 134 may be any suitable limit valves such as the 3-way limit valve manufactured by Norgren and sold under Model No. H41AA01-HSO-HL2. The limit switches are generators of pneumatic feedback signals important in the operation of the filling apparatus of the present invention. By disposing the limit switch assemblies on the rear portion of the stanchion 24, they are isolated from the danger of spill or spray associated with product dispensation and, therefore, enhance the safety characteristics of this liquid filling apparatus.

The body 136 of the limit switch is mounted in an appropriate manner, such as by welding, to a flange 140 affixed to the transverse web of the stanchion 24. A hinged pin member 138 extends from the limit switch body 136 as shown in FIG. 4. The pin member 138 shown in FIG. 4 is in a non-actuated position and is urged to that position by appropriate means such as a spring element in the limit switch body 136. The pneumatic connections and fittings extending from the limit switches to the pneumatic control panel are not shown but will be understandable to those skilled in the art.

A trip mechanism 142 is provided on the back side of the carriage 26 for the purpose of actuating the three limit switches 130, 132 and 134. The trip mechanism 142 consists of a bevelled flange 144 mounted to an extension plate 146 or arm which is in turn fixed to the back of the carriage 26. The bevelled flange 144 is longitudinally axially aligned with the pin members of the three limit switches such that when the trip mechanism 142 passes a limit switch, the particular pin member is pivoted about its hinge point to an actuated position. This action provides feedback to the control panel 22. When the carriage 26 is caused to move, the pin member of a limit switch is released to its original unactuated position. The specific function of each of the three limit switches 130, 132 and 134, respectively, will be explained more fully.

The upper limit switch 130 is located at a first position on the stanchion 24 which represents the raised or uppermost position of the carriage 26, and specifically of the trip mechanism 142. This first position corresponds with the lance 28 being in its raised or fully withdrawn position, such as represented in FIG. 2.

The lower limit switch 134 is located at a second position on the stanchion 24 which represents the lowermost position reached by the carriage 26, and again specifically by the trip mechanism 142. The second position corresponds with the lance 28 being in its fully lowered or "inserted" position, wherein the emission end 40 of the lance 28 is disposed just above the bottom of the container being filled.

The middle limit switch 132 is located at a third or intermediate position between the first and second positions, respectively. This third position corresponds with the lance 28 being in a substantially withdrawn position with respect to the bottom of the container, but at a position for the particular size container being filled wherein the lance emission end 40 will remain subsurface of the liquid being introduced into the container when approximately 90% or better of the liquid weight has been dispensed. The middle limit switch 132 may be secured to the stanchion 24 in a manner which would permit longitudinal shifting of the switch to accommodate variations in volume, and hence height, of liquids at 90% full dispensation by weight being introduced into standard-size containers.

As previously noted, the operations of the filling apparatus described herein are pneumatically instigated, with the pneumatic circuitry housed in the control panel 22. In the preferred embodiment, a customized plastic logic subplate such as manufactured and sold by Clippard (see Clippard Instrument Laboratory, Inc., Catalog 477-A1, 1977) is utilized, which subplate has the necessary interconnections engraved therein and permits the valves simply to be plugged into the subplate. This arrangement eliminates the need for the tubing and fittings between valves within the control panel and permits easy maintenance of the control logic. The logic interconnections for the subplate utilized in the preferred embodiment are represented by the schematic shown in FIG. 8.

Figure 8:
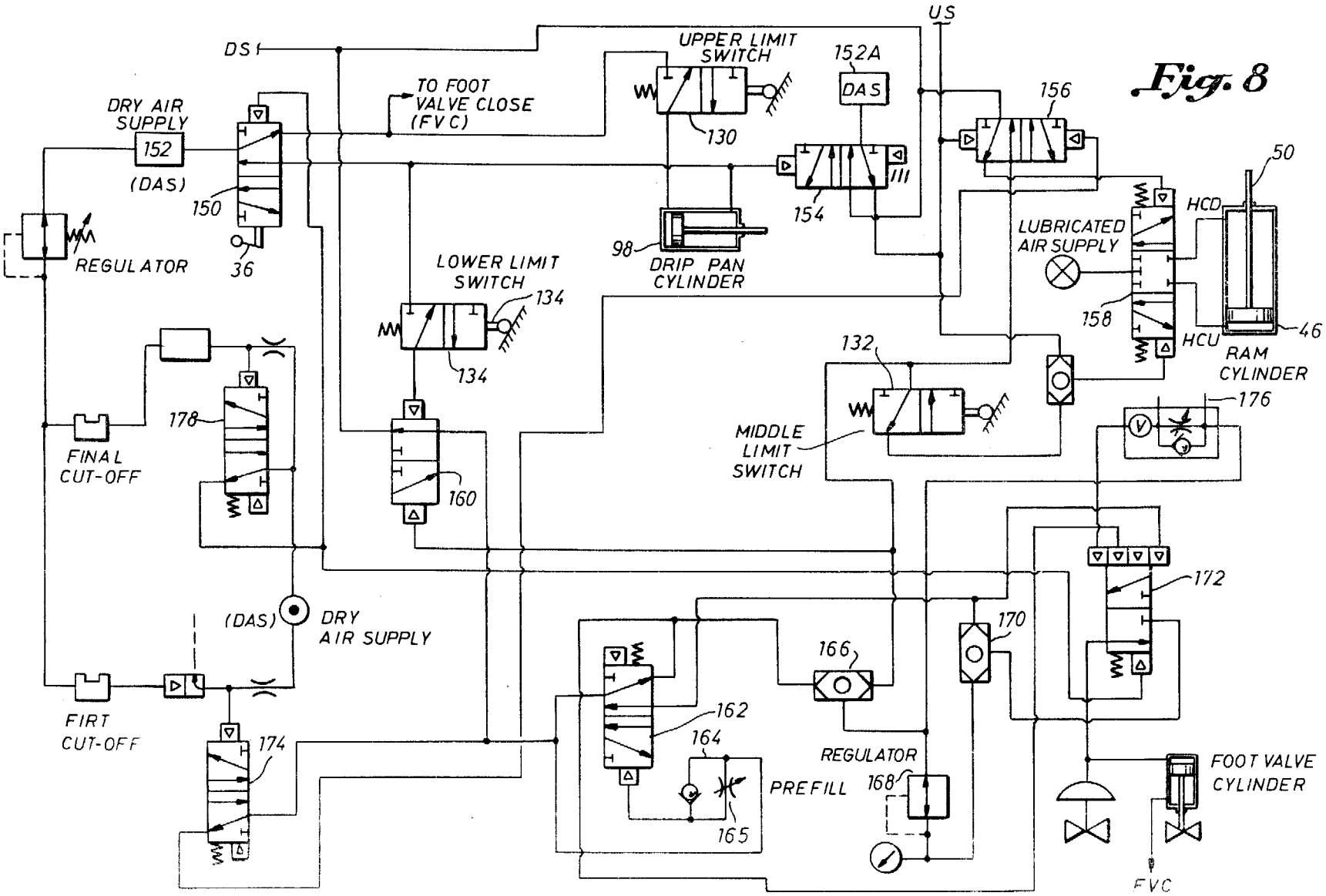
FIG. 8 is a schematic diagram of a pneumatic interface arrangement adapted for use with the liquid apparatus of FIG. 1.

With reference now to FIG. 8, a schematic diagram of a preferred form of pneumatic interface circuitry as utilized in connection with the liquid filling apparatus of this invention is shown. The interface circuitry is operatively associated with the scale 18 and is responsive to the first and second control signals generated thereby, as well as to the start signal generated with the start lever 36 and to the feedback signals generated from the limit switch assemblies 130, 132 and 134, respectively, to apply the appropriate one of the actuating forces F-1 or F-2 to the actuator 32. As described in U.S. Pat. No. 4,211,263 the incorporated reference, application of the actuating forces operates to cause the actuator 32 to open the valve element within the control valve 30 to present the appropriate cross-sectional area to the liquid flow path from the source 14 to the conduit or lance 28.

The operation of the liquid filling apparatus of the present invention and the method for subsurface filling of a container will be explained hereinafter as would be utilized for a product being introduced into a container, which product is either subject to foaming or to giving off noxious fumes.

The container 12, which is to be filled with a predetermined weight of liquid, is first appropriately positioned beneath the emission end 40 of the lance 28. The start lever 36 is pulled down, opening valve 150 to allow air pressure from a dry air supply 152 to actuate the retraction of the drip pan piston rod 100 and hence the drip pan 92 from the path of the lance 28. This same pneumatic signal actuates a valve 154, thereby permitting an air pressure signal from a dry air supply 152A to actuate a valve 156 and thence valve 158 which pressurizes the HCD port of the ram 46 and causes the ram piston 50 to retract. Valve 158 may be any suitable 4-way valve such as manufactured by Clippard and sold under part number R421. The result is the lowering of the carriage 26 and of the lance 28 into the container 12 to a position where the emission end 40 of the lance is just above the bottom of the container.

The pulling of the start lever 36 also permits the air signal from supply 152 to arrive at the lower limit switch 134 which is spring biased in an a non-actuated position, thereby not allowing this signal to activate valve 160. However, when the carriage 26 reaches its low point, the lower limit switch pin is actuated by the trip mechanism 142, thus allowing the air signal from supply 152 to activate the valve 160 and permit passage of a pressurized air signal from air source 152 to a valve 162 and a delay timer 164. This signal is immediately passed through a shuttle valve 166 and then through a regulator 168 which reduces the pressure of the signal. Therefore, a reduced pressure signal is transmitted through a shuttle valve 170 and a valve 172 (such as a 3-way multiple pilot valve as manufactured by Clippard and sold under part number R-311) to the actuator 32 and control valve 30, causing the control valve to open to a dribble fill rate. This signal is also delivered to the foot valve actuator 64, causing the foot valve to open fully.

The dribble fill of the liquid into the container begins and continues for a preset interval of time (called prefill) to allow the level of liquid introduced into the container to rise above the emission end 40 of the lance 28. This time may be set by the operator by controlling the restriction 165 of timer 164.

Once the preset interval has passed, the signal passed through the valve 162 is directed to the valve 172 without passing through the regulator 168 and acts to open fully the control valve 30 to permit fast fill of liquid into the container.

The fast fill condition continues until such time as the weight of the liquid in the container 12 reaches the first cut-off weight, at which time the scale 18 generates its first control signal. The first control signal may be generated when about 90% of the desired liquid weight has been achieved. This first control signal actuates a valve 174 (such as a 4-way electronic valve manufactured by Clippard and sold under part number R-481), which in turn sends a signal to the valve 156, which in turn will actuate a signal passing through the middle limit switch 132 (the unactuated position of the middle limit switch representing an open channel therethrough) to the valve 158 and port HCU of the ram 46. Consequently, the ram piston 50 will rise and begin to lift the carriage 25 and lance 28 from its lowered position. The pneumatic logic of the present invention is particularly advantageous in that it is readily adaptable to the use of electronic or mechanical type scales. Where an electronic scale is utilized, two solenoids may simply be plugged into the logic subplate, or into a remote panel pneumatically associated with the control panel 22, to translate the electrical signals (generated in response to the first and second cut-off weights being achieved) to pneumatic signals.

When the carriage begins to rise, the lower limit switch 134 will return to an unactuated position and the signal to the valve 160 will be interrupted and will consequently interrupt the signal to the control valve 30, thus causing the shut off of the flow of liquid into the container 12. However, the same signal from the valve 156 which triggers the upward movement of the carriage will also be introduced through the shuttle valve 166, simultaneously to the regulator 168 and to the timer 176. From the regulator 168, the signal will arrive at the valve 172 at a reduced pressure and will actuate the partial opening of the control valve 30 (the dribble fill rate) when the delay effect of timer 176 has been dissipated on the valve 172. The foot valve 40 is generally not caused to close fully by the interruption of the signal through the valve 160 inasmuch as the delay period is brief and the force of spring 68 is not so great that instantaneous closure would be achieved.

An outstanding feature of this invention is the automatic withdrawal of the lance 28 from the container 12, while maintaining the emission end 40 of the lance under the surface of the liquid within the container. This feature is believed to greatly reduce operator fatigue and frustration where this task had previously been performed or controlled manually. The middle limit switch assembly 132 is appropriately positioned on the stanchion 24 such that it will effect the stoppage of the withdrawal of the lance 28 from the container 12 at a level where the emission end 40 of the lance will always be subsurface when substantially 90% or better of the weight of the liquid has been dispensed into the container 12. Such a level (and hence the proper positioning of the middle limit switch 132) will generally be known for various sized containers by those persons skilled in the field.

When the rising carriage 26 and its trip mechanism 142 trigger the middle limit switch 132, air signals through the limit switch assembly 132 are cut off and air pressure to the cylinder ports HCD and HCU of the valve 158 is blocked. The ram piston 50 is therefore stopped and held at its then present position.

Dribble fill of the liquid into the container continues until the scale 18 registers the final preset cut-off weight. When this final weight cut-off point is reached, a second control signal is generated from the scale 18 to the valve 178 which in turn passes a signal to the valve 172, cutting off air pressure to the actuator 32 for the control valve and the actuator 64 for the foot valve. Inasmuch as the actuator 32 for the control valve and the foot valve 40 have spring returns, the flow of liquid through the control valve 30 and conduit is shut off completely at this point. The signal leaving the valve 178 is also directed to the start valve 150, which returns the start lever 36 to its original position. This causes a pressure signal to be transmitted to close the foot valve 40 positively, as well as to the valve 158 such that the ram piston 50 is returned to its uppermost position.

The closing of the foot valve 40 traps the liquid remaining therein at the time the control valve 30 closes. This increases the accuracy of the filling apparatus in that extra liquid from the lance is not allowed to enter the container after the final weight cut-off has been achieved.

When the carriage 26 returns to its uppermost position, the upper limit switch 130 is triggered by the trip mechanism 142 and a pressure signal is passed to actuate the drip pan piston rod 100 and extend it, thereby returning the drip pan 92 to a position beneath the lance 28. The liquid filling apparatus 10 is then back to its quiescent state in preparation for the next fill.

It will thus be appreciated that an improved liquid filling apparatus has been described which is of simple and durable construction and which enhances safe handling of hazardous materials. An outstanding feature of the filling apparatus is the automatic actuation and control of the withdrawal of the lance from the container into which the liquid is being dispensed, thereby reducing operator fatigue and frustration and increasing the accuracy of the filling operation. Other outstanding features of the invention include the drip collection apparatus, which eliminates the need for a drainage hose which must be translated back and forth as a drip pan is moved under the lance, and the fume disposal assembly, which contains essentially all the sources of fume generation and which includes a baffle to regulate the removal of fumes from the filling area.

Having described the preferred embodiment of the invention, those skilled in the art may effect numerous modifications thereto in view of the foregoing description. It is, however, understood that such modifications lie within the contemplation and scope of this invention as defined in the appended claims.

What is claimed is:

1. Liquid filling apparatus for subsurface filling of containers with liquid comprising:

a conduit for introducing the liquid into a container, said conduit being movable between a raised and a lowered position;

a valve to control the rate of flow of liquid through the conduit to such a container;

a first signal generator for generating a signal to initiate movement of the conduit from its raised position to its lowered position;

a second signal generator actuatable by movement of the conduit towards its lowered position, for generating a signal to actuate the valve to commence flow of liquid at a slow fill rate into such a container;

a delay mechanism actuatable by the signal from the second signal generator to trigger a fast fill rate dispensation of liquid after a predetermined interval;

a weight responsive device adapted to generate a first and a second control signal when the weight of the liquid in the container equals a first and a second cut-off weight, respectively, said first control signal being operable to initiate withdrawal of the conduit towards its raised position and to actuate the valve to return to a slow fill rate of dispensation of liquid through the conduit;

a wiper device for urging liquid adhering to the outside of the conduit toward such a container during withdrawal of the conduit; and a third signal generator actuatable when the conduit has been raised a predetermined distance from such a container for generating a signal to stop further movement of the conduit, said second control signal, which is generated when the second cut-off weight of liquid within such a container is achieved, initiates the termination of flow of liquid from the conduit and the movement of the conduit to its raised position.

2. The liquid filling apparatus of claim 1 further comprising:

a movable collection reservoir; and a fourth signal generator actuatable by movement of the conduit to its raised position for generating a signal to initiate movement of the collection reservoir to a position beneath the conduit, thereby to collect any liquid adhering to the conduit as it drips therefrom.

3. The liquid filling apparatus of claim 2 wherein the movable drip collection reservoir is contained within a fume disposal assembly.

4. The liquid filling apparatus of claim 2 further comprising:

a fixed collection receptacle disposed below the movable drip collection reservoir;

a fixed drainage hose leading from the fixed collection receptacle to a final collection source; and wherein the movable drip collection reservoir is provided with a drain port which is always disposed over the fixed collection receptacle.

5. The liquid filling apparatus of claim 4 wherein the movable drip collection reservoir and the fixed collection receptacle are contained within a fume disposal assembly.

6. The liquid filling apparatus of claim 1 further comprising a fixed wiper ring disposed about the conduit such that withdrawal of the conduit from the liquid in the container causes liquid particles collected on the conduit to be urged in the direction of the container.

7. The liquid filling apparatus of claim 6 wherein the wiper ring is contained within a fume disposal assembly.

8. The liquid filling apparatus of claim 1 wherein the emission end of the conduit is provided with a foot valve movable between an open and a closed position, said foot valve being opened in response to the second signal and being closed in response to the second control signal.

9. The liquid filling apparatus of claim 1, further comprising:

a fume disposal assembly; and a baffle element on the fume disposal assembly to control the withdrawal of fumes from the filling area.

10. The liquid filling apparatus of claim 1, further comprising:

a stanchion; and a wheeled carriage mounted for movement upward and downward on the stanchion and operatively associated with the conduit to control the movement of said conduit.

11. A liquid filling apparatus for dispensing a predetermined quantity of liquid, by weight, into a container comprising:

a base having a stanchion extending upwardly therefrom;

a carriage mounted for movement along the stanchion;

a filler lance mounted for movement with the carriage;

a control valve mounted on the carriage, said control valve being in communication with a liquid source and with the filler lance, said control valve being operable to allow passage of liquid at a dribble or fast-fill rate;

an actuator operatively associated with the control valve and responsive to a first and a second control signal to move the valve element to a position permitting dribble fill and to a position permitting fast-fill, respectively;

an arm assembly extending outwardly from the stanchion over the container to be filled, the filler lance extending through the outer end of the arm assembly in a guided relationship therewith as the lance is moved with the carriage into and out of such a container;

a start mechanism for generating a start signal to move the filler lance from a raised position to a lowered position in such a container such that the emission end of the filler lance is disposed just above the bottom of such a container;

a second signal generator for generating a second signal to initiate the dribble filling of such a container, said second signal generator being actuated by the carriage when the emission end of the filler lance is disposed just above the bottom of such a container;

a delay timer actuated by the second signal which triggers fast-fill of the container after the liquid in such a container has risen to a level above the emission end of the filler lance;

a scale adapted to generate the first and the second control signals when the weight of the liquid within such a container equals a first and a second cut-off weight, respectively;

said first control signal being operable to initiate upward movement of the filler lance from the lowered position, to stop the fast-filling of the liquid into such a container, and to trigger dribble fill of liquid into such a container; and a third signal generator for generating a third signal which stops the conduit at an intermediate position between its raised and lowered positions, said third signal being responsive to the upward movement of the carriage;

said second control signal being operable to stop the dribble filling of the liquid into such a container and to move the filler lance back to its raised position.

12. The liquid filling apparatus of claim 11 wherein the arm assembly comprises:

a wiper ring apparatus for wiping liquid collected on the outside surface of the lance as it is withdrawn from such a container;

a fume disposal apparatus for removal of fumes generated by the liquid being introduced into such a container; and a drip collection apparatus for collecting and dispensing liquid which drips off the filler lance after said filler lance is withdrawn from such a container.

13. The liquid filling apparatus of claim 12 wherein the wiper ring apparatus includes a wiper seal ring mounted at the outer end of the arm assembly in a close wiping relationship with the filler lance.

14. The liquid filling apparatus of claim 12 wherein the fume disposal apparatus comprises:

a fume entrapping skirt below the arm assembly;

an enclosure of the wiper ring apparatus which communicates with the fume entrapping skirt;

an enclosure of the drip collection apparatus which communicates with the fume entrapping skirt; and a channel element mounted to the arm assembly and including an exit portal for communication with a vacuum system, and wherein a port exists between the channel element and the fume entrapping skirt.

15. The liquid filling apparatus of claim 14 wherein the channel element is provided with a baffle plate to allow adjustment of the vacuum force generated at the port in the fume entrapping skirt and within the channel element.

16. The liquid filling apparatus of claim 12 wherein the drip collection apparatus comprises:

a movable drip pan, movable between a first position directly beneath the filler lance when the filler lance is in a fully withdrawn position and a second position removed from the lance travel path, and wherein the movable drip pan has a drainage port; and a fixed collection receptacle disposed beneath the movable drip pan, said fixed collection receptacle having a drainage port for communication with a hose extending to a removed collection source, wherein the drainage port of the drip pan is always disposed above and in communication with the fixed collection receptacle.

17. A method for filling a container with a predetermined weight of liquid, which liquid is subject to foaming or the production of toxic or noxious fumes, comprising the steps of:

actuating the movement of a conduit for the introduction of the liquid into the container to a predetermined position just above the bottom of the container;

introducing liquid into the container at a dribble fill rate for a predetermined time until the end of the conduit is submerged in the liquid, the liquid introduction beginning in response to a signal generated when the conduit reaches its position just above the bottom of the container;

increasing the liquid introduction to a fast fill rate in response to a signal generated by the lapse of the predetermined time for the dribble fill rate;

activating the withdrawal of the conduit a predetermined distance which maintains the conduit end submerged in the liquid and the return of the liquid introduction to a dribble fill rate in response to a signal generated by the achievement of a first predetermined cut-off weight of liquid within the container;

wiping the external surface of the conduit during the withdrawal of the conduit in a manner which urges the liquid adhering to the conduit into the container; and, initiating full shut-off of liquid flow through the conduit and full withdrawal of the conduit from the container in response to a signal generated when a second predetermined cut-off weight of liquid in the container is achieved.

18. The method of claim 17 further comprising the step of:

moving a collection device beneath the conduit in response to a signal generated when the conduit is fully withdrawn, thereby to collect any excess liquid adhering to the conduit as it drips therefrom.

* * * * *